US007562546B2

(12) United States Patent
Taylor

(10) Patent No.: US 7,562,546 B2
(45) Date of Patent: Jul. 21, 2009

(54) LOCKING SYSTEM

(75) Inventor: William Taylor, Linden, NJ (US)

(73) Assignee: JDM Venture LLC, Belle Harbor, NY (US)

( * ) Notice: Subject to any disclaimer, the term of this patent is extended or adjusted under 35 U.S.C. 154(b) by 0 days.

(21) Appl. No.: 11/818,816

(22) Filed: Jun. 15, 2007

(65) Prior Publication Data

US 2008/0000273 A1 Jan. 3, 2008

Related U.S. Application Data

(60) Provisional application No. 60/814,130, filed on Jun. 16, 2006.

(51) Int. Cl.
*E05B 67/36* (2006.01)

(52) U.S. Cl. ..... 70/23; 70/32; 70/51; 70/56; 70/451; 70/466; 248/551

(58) Field of Classification Search ..... 70/23, 70/32–34, 54–56, 129, 2, 6, 30, 49, 51, 52, 70/431, 451, 466, DIG. 12; 24/490, 523, 24/601.6; 248/551–553; 292/148, 205; 403/321, 403/322.1, 322.4, 330
See application file for complete search history.

(56) References Cited

U.S. PATENT DOCUMENTS 834,591 A * 10/1906 Streams ..... 70/6
1,783,905 A * 12/1930 Copell ..... 70/32
3,404,549 A 10/1968 Best
3,415,085 A * 12/1968 Eble, Jr. ..... 70/232
3,744,280 A * 7/1973 Brown et al. ..... 70/54
3,769,821 A 11/1973 Randel
3,820,360 A 6/1974 Best
4,095,828 A * 6/1978 East ..... 292/148
4,512,165 A * 4/1985 Uyeda ..... 70/32
5,172,574 A 12/1992 Perfetto
5,462,319 A 10/1995 Roden, Jr.
5,469,722 A * 11/1995 Ellefsen ..... 70/56
5,669,255 A 9/1997 Albano
6,233,984 B1 * 5/2001 Blehi, III ..... 70/34
7,047,774 B1 * 5/2006 Gogel ..... 70/32
7,162,898 B2 * 1/2007 Gogel ..... 70/14
7,290,415 B2 11/2007 Rosenberg et al.
2005/0252257 A1 * 11/2005 Woods et al. ..... 70/33

* cited by examiner

*Primary Examiner*—Lloyd A Gall
(74) *Attorney, Agent, or Firm*—Fulbright & Jaworski L.L.P.

(57) ABSTRACT

The present invention is a locking system comprising a cylindrical padlock, a lock securing member attached to the cylindrical padlock, a padlock guard, a hasp plate, and at least one of the following: an outer flange on the padlock guard mounted parallel to the hasp plate or an outer flange on the hasp plate mounted perpendicular to the hasp plate. The locking system allows the user to securely store the lock when it is not in use.

10 Claims, 8 Drawing Sheets

LOCKING SYSTEM

This application claims priority from provisional application Ser. No. 60/814,130, filed Jun. 16, 2006 incorporated herein by reference in its entirety.

This invention relates to a locking system, which includes a padlock guard for a cylindrical shackle-less lock which allows the user to securely store the lock when it is not in use.

BACKGROUND OF THE INVENTION

The theft of property from vehicles such as trucks, vans, recreational vehicles, trailers, and the like, or stationary structures such as stores, warehouses, garages, barns, and the like, is problem of constant concern, and has fueled the need for high-quality locks to keep doors securely closed and prevent unauthorized access.

A thief attempting to gain access to the contents of a vehicle or structure often attacks the lock, and over the years, there have been many attempts to develop locks and other devices which deter criminals by making it more difficult to tamper with or disable the lock. For example, conventional padlocks with a u-shaped shackle are a prime target for thieves, since the shackle can be easily cut with a bolt cutter or sawed off with a hacksaw.

Other high-security, non-conventional padlocks have been created in an attempt to protect vehicles, truck bodies, slot machines, automatic teller machines and other areas and equipment against unauthorized entry. A number of such high-security padlocks have a generally short, cylindrical body shape, resembling a hockey-puck. Locks of this sort are shown in Best U.S. Pat. No. 3,404,549; Randel U.S. Pat. No. 3,769,821; and Best U.S. Pat. No. 3,820,360. The principal difference between these cylindrical locks and the conventional padlocks is, of course, the fact that it did not have the usual U-shaped link or shackle, i.e., that it had no exposed element which could be rapidly and relatively easily cut through by a bolt cutter or sawed through by a hacksaw.

To further enhance the security afforded by these cylindrical locks, guards have been designed to surround the lock bodies and prevent or inhibit the lock bodies from attack by pry bars or other instruments. Guards of this sort are shown in Perfetto U.S. Pat. No. 5,172,574 and Albano U.S. Pat. No. 5,669,255. For example, Perfetto discloses a locking system utilizing a padlock guard which is designed specifically for use with a cylindrical lock. The lock has a flat-faced cylindrical housing and an internal key cylinder-operable bolt which can be selectively protracted through and retracted from a hasp staple or the like inserted into a channel in the housing which intersects the path of movement of the bolt. A previously affixed guard encircles the lock which, by virtue of its interposed position between a tampering tool and the lock, minimizes the unauthorized non-key removal of the lock.

While the cylindrical locks and lock-protecting guards of the aforesaid and all other known prior art efforts are generally effective for the purposes intended, none of the previous cylindrical locks and lock-protecting guards provide means for securing the cylindrical lock when the lock is not in use. For example, such a lock and protective guard are often used on the back doors of trucks or vans. The protective guard is affixed to one or both of the rear doors. When the doors are opened, i.e., for loading and unloading the contents of the truck, the lock is not in use. The individual that is loading/unloading the truck may place the lock on the rear bumper, or the ground until their task is complete. This often results in misplacing or losing the lock, which is not inexpensive to replace. Hence, there is the need for a protective guard for cylindrical locks which allows the user to securely store the lock when it is not in use.

OBJECTS OF THE INVENTION

It is an object of the present invention, therefore, to provide a novel and improved locking system which includes a padlock guard that is specifically designed for use with cylindrical shackle-less locks, whereby the lock and guard have means to securely store the lock when it is not in use.

It is another object of the present invention that such a locking system be easily constructed, but be difficult and time-consuming for a thief to destroy.

DETAILED DESCRIPTION OF THE INVENTION

Figure 1:
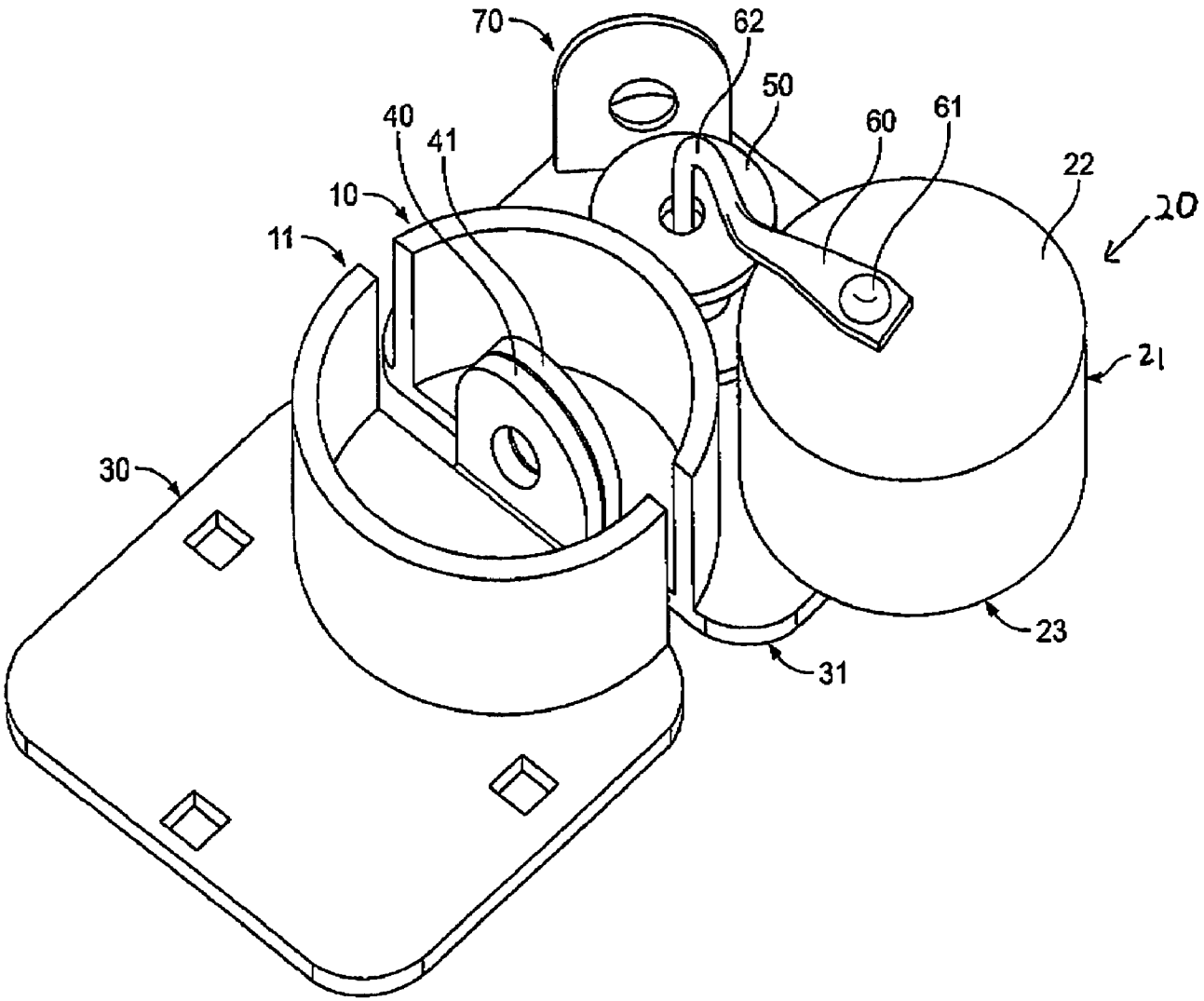
FIG. 1 depicts a locking system for sealing the doors of a vehicle, when the lock is not engaged.

Referring to FIG. 1, a locking system according to the invention includes a padlock guard 10 which has a substantially cylindrical shell. Guard 10 is made of a sheet or strip of a high strength metal, e.g., steel, having a sufficient hardness to be highly resistant to sawing, hammer blows, and the like, and has an inside diameter slightly greater than the outside diameter of the cylindrical lock 20 so as to accommodate the housing lock 20 freely but with a nearly sliding fit, and a depth somewhat greater than the thickness of the cylindrical lock so that no part of the lock protrudes beyond the front edge 11 of the guard 10, when the lock 20 is in use.

The padlock 20 includes a cylindrical body 21 preferably made of steel or a suitable metal or metal alloy. Cylindrical body 21 has substantially flat opposite front and back faces (22, 23), a channel that extends inwardly of the cylindrical body from the back face 23 toward but terminating short of the front face 22, and an opposite passageway extending inwardly from one part of circumferential face of the cylindrical body and intersecting the channel substantially in the center of the cylindrical body. Within the passageway section is a key cylinder which at its outward end has an opening to receive a key and which at its inward end carries a bolt. When a key is inserted into the key cylinder and turned, the bolt can be extended by the key cylinder across the channel and into the passageway section, or can be drawn back by the key cylinder from the passageway section so as to render the channel empty.

Figure 2:
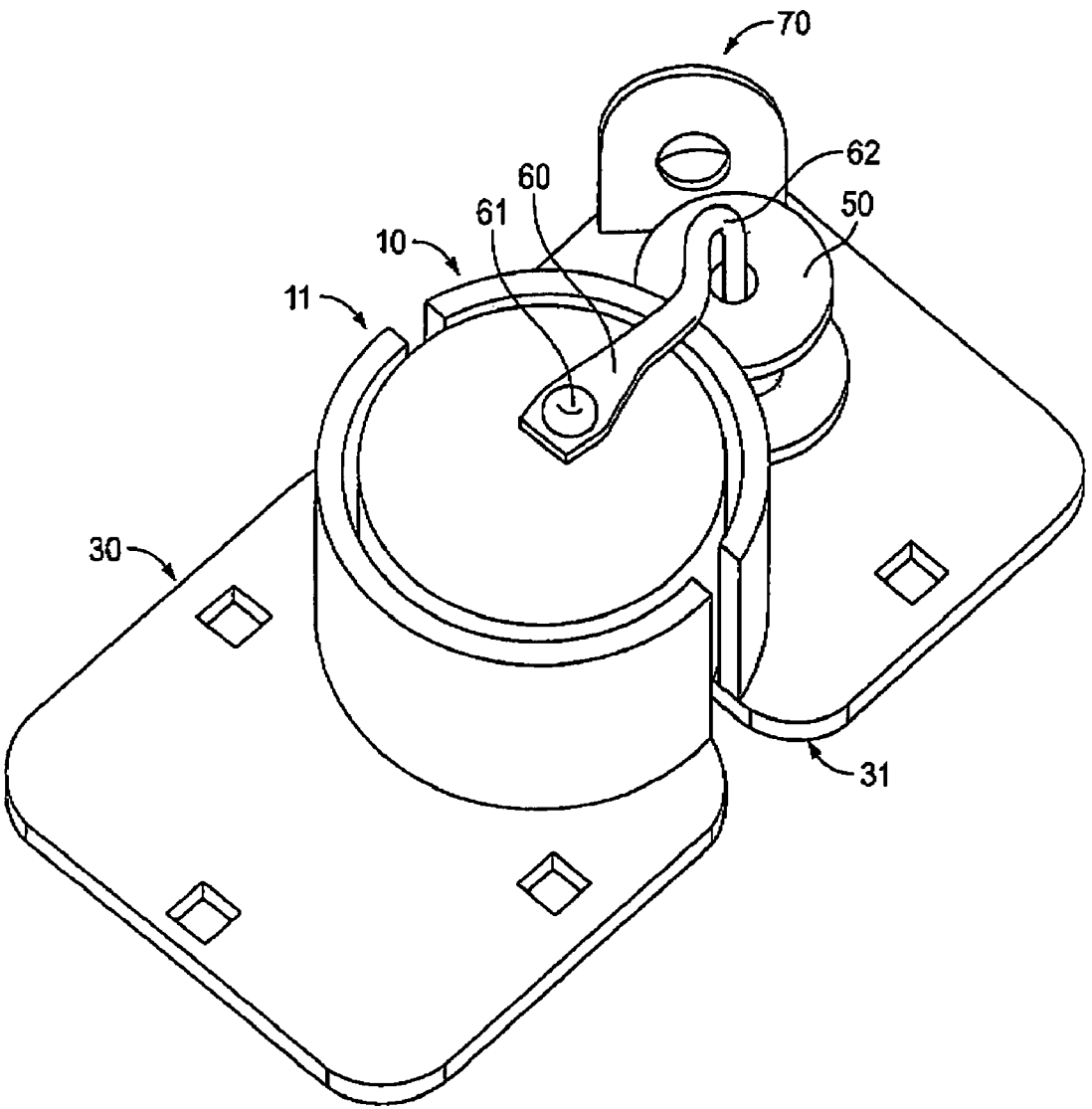
FIG. 2 depicts a locking system for sealing the doors of a vehicle, when the lock is engaged.

In an embodiment of the present invention, as shown in FIGS. 1 and 2, where the lock 20 is to be used with a hasp (30, 31) for sealing the doors of a protected vehicle such as a truck or van, the guard is axially split in two pieces (10, 11), as is the hasp plate (30, 31). Each portion of the guard (10, 11) is affixed at its rear edge to the front face of a hasp plate (30, 31), which are then affixed to the doors of the vehicle. Inner edge of each hasp plate (30, 31) has a flange (40, 41) with a hole at the center mounted perpendicular to the hasp plate, such that the center holes of the two flanges (40, 41) match up and are located in the center of the guard (10, 11). The channel of the lock 20 is placed over the center flanges (40, 41) and, when the bolt is extended across the channel, the bolt will slide through the two center holes of the flanges (40, 41), so as to engage the lock 20. One portion of the guard (10, 11) has an outer flange 50 with a hole at the center, mounted parallel to the hasp plate (30, 31). Lock 20 has a lock securing member 60 with one end 61 attached to the outer face 22 of lock 20 and a second hook end 62 that extends past the edge of the lock 20. Lock securing member 60 and outer flange 50 are considered independent elements of the invention. Hook 62 of lock securing member 60 can be inserted into the hole of the outer flange 50 to secure the lock when it is not in use. Each hasp plate (30, 31) is mounted to opposite doors of the vehicle, via bolts through bolt holes, such that the center holes of the two flanges (40, 41) align and are located at the point where the two vehicle doors meet.

Figure 3:
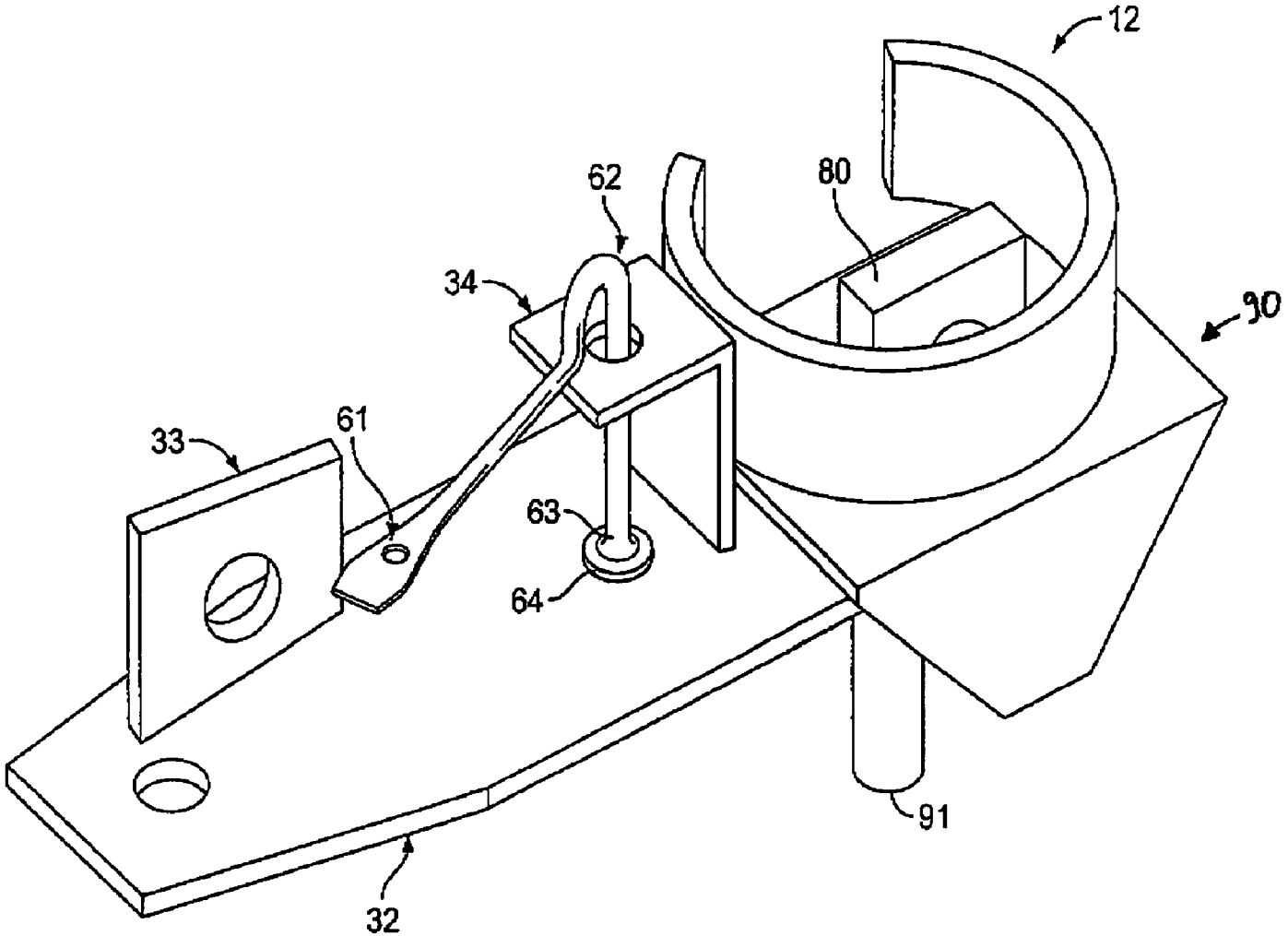
FIG. 3 depicts a locking system for securing the roll-down gate of a truck or storefront.

In a further embodiment of the present invention, as shown in FIG. 3, hook end 62 is approximately the width of the guard (10, 11) such that the hook end 62 begins at the hasp plate (30, 31) and extends orthogonally from the hasp plate (30, 31) approximately the length the guard (10,11) orthogonally extends from the hasp plate (30,31). End portion 63 of hook end 62 has metal stopper 64 mounted to it. Stopper 64 has a diameter greater than the center hole of flange 34, such that the hook/lock combination can be lifted out of the guard (10, 11) (clearing the top portion of the guard (10, 11)) and rotated to the side when the lock is not engaged. Stopper 64 prevents hook end 62 from being removed from flange 34.

In a further embodiment of the present invention, as shown in FIG. 3, hook end 62 extends the width of the guard (10, 11) such that it meets the hasp plate (30, 31). End portion 63 of hook end 62 has metal stopper 64 mounted to it. Stopper 64 has a diameter greater than the center hole of flange 50, such that the hook/lock combination can be lifted out of the guard (10, 11) (clearing the top portion of the guard (10, 11)) and rotated to the side when the lock is not engaged. Stopper 64 prevents hook end 62 from being removed from flange 50.

Figure 4:
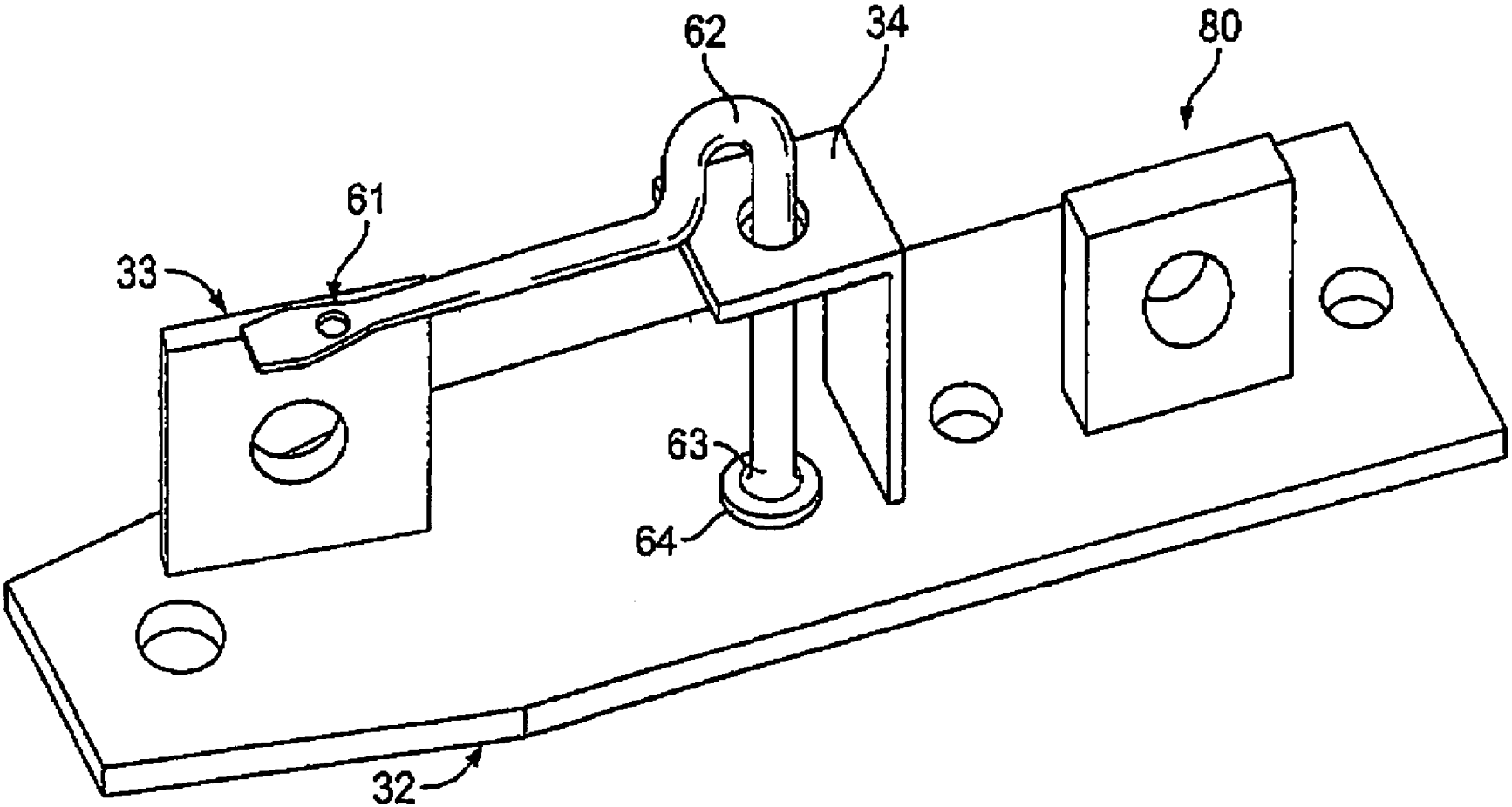
FIG. 4 depicts the hasp plate of the locking system shown in FIG. 3.
Figure 5:
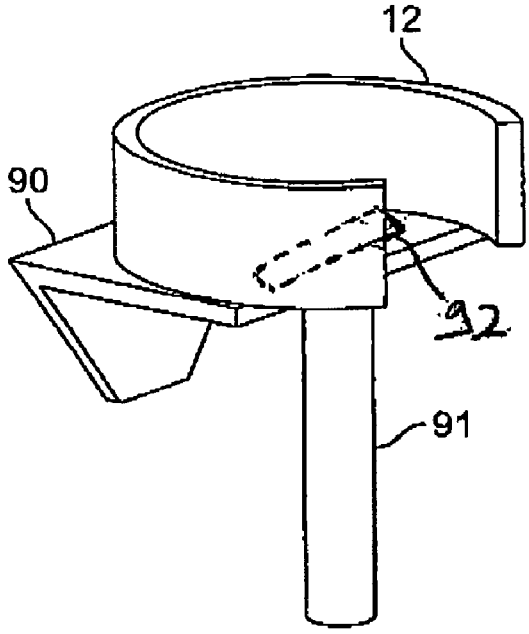
FIG. 5 depicts the guard of the locking system shown in FIG. 3.
Figure 6:
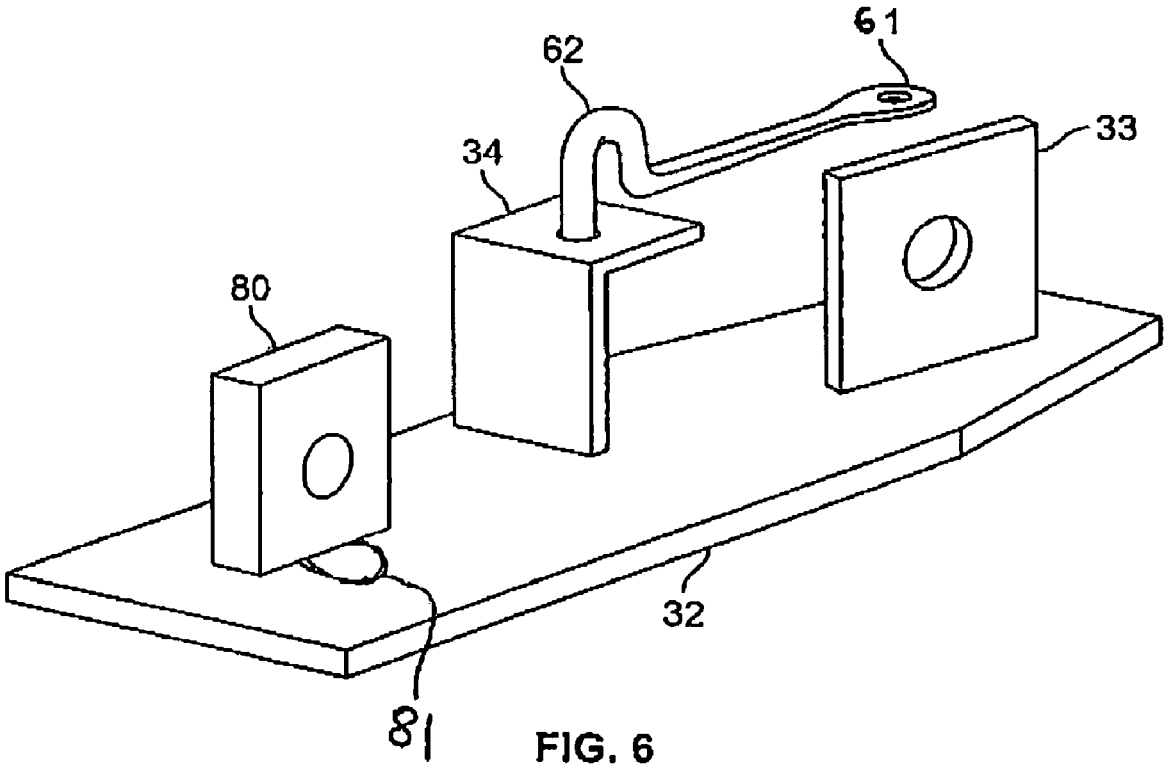
FIG. 6 is an alternate view of the hasp plate of the locking system shown in FIG. 3.
Figure 7:
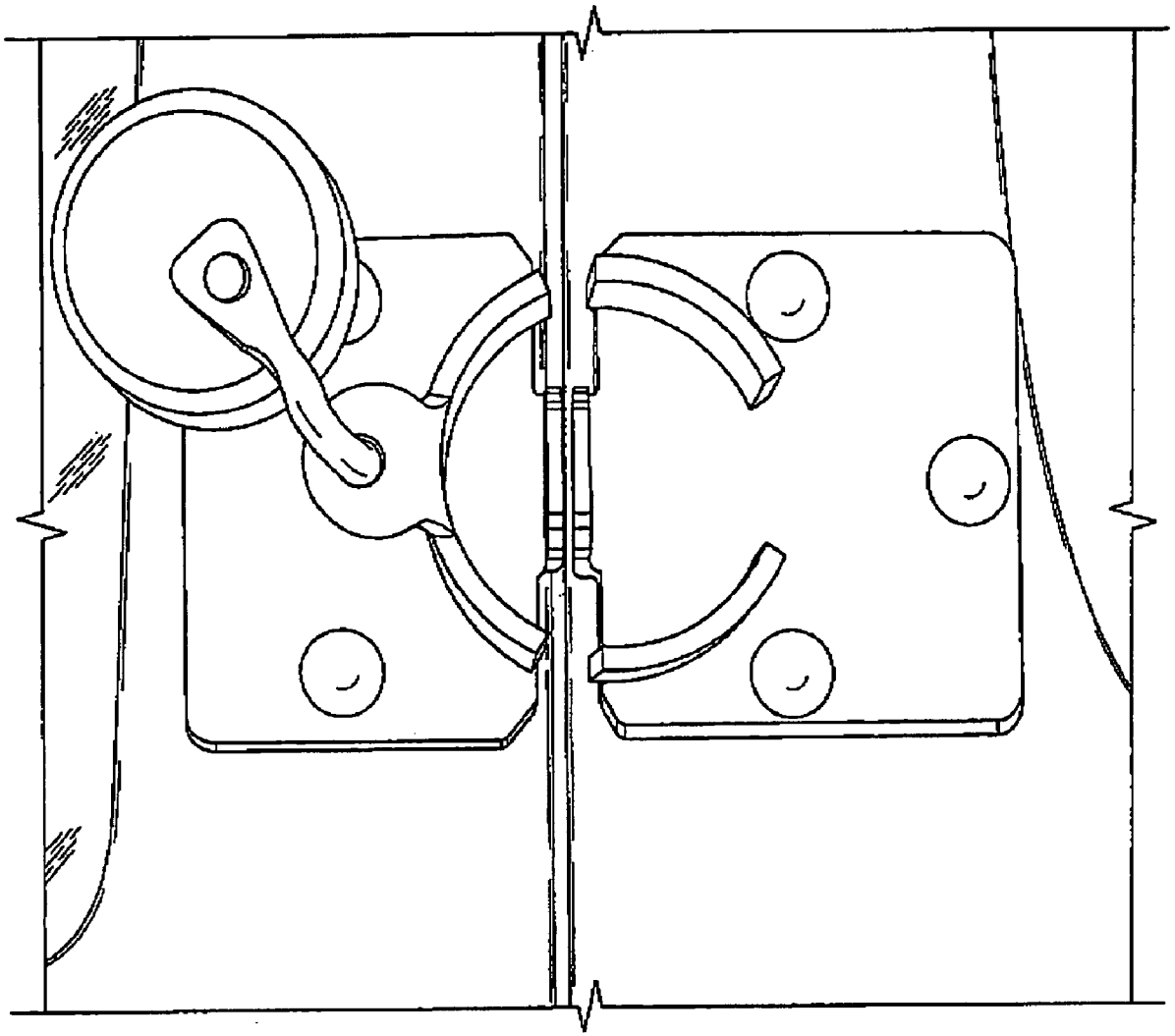
FIGS. 7, 8 and 9 depict a locking system of the present invention in use on a vehicle.
Figure 8:
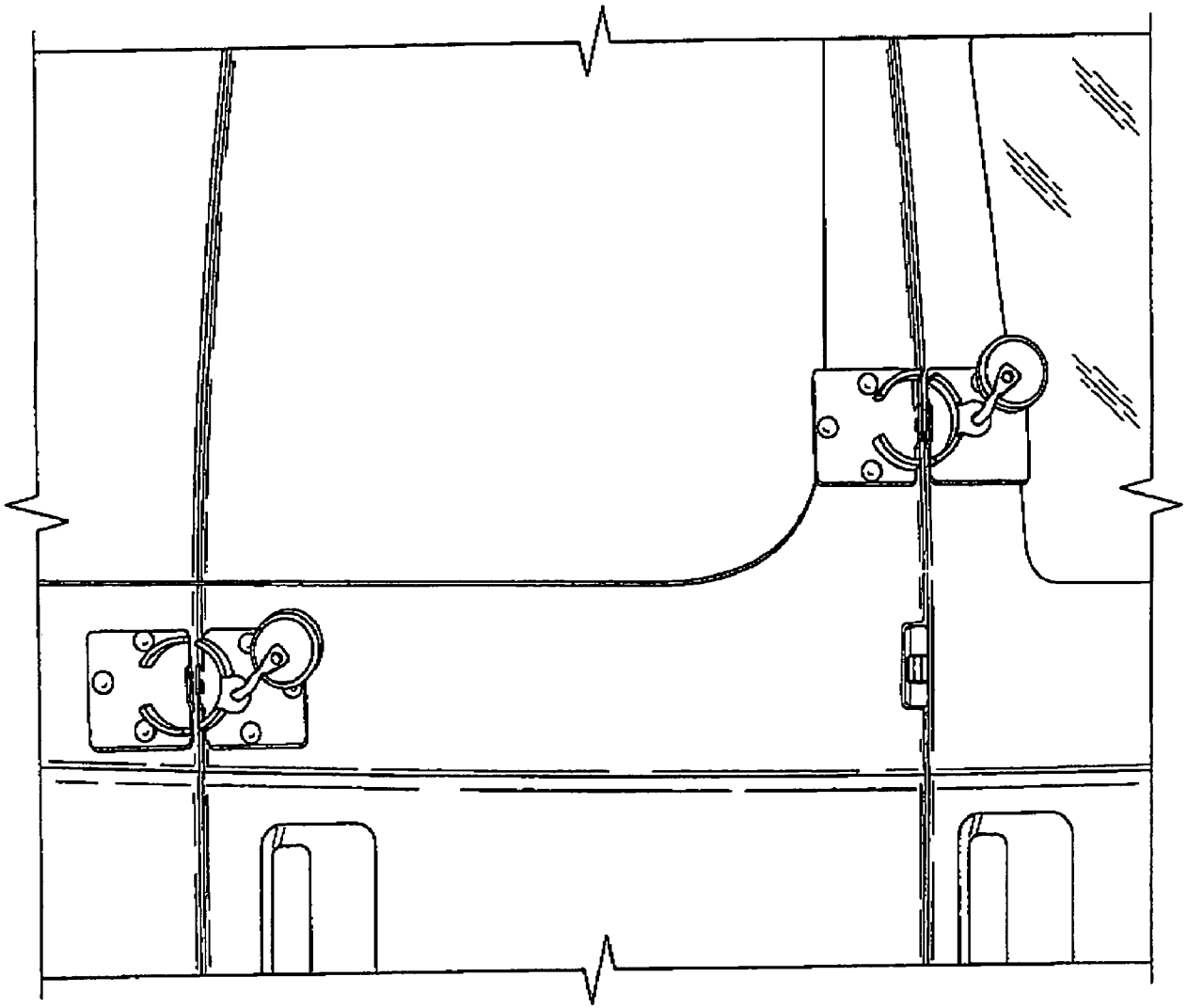
Figure 9:
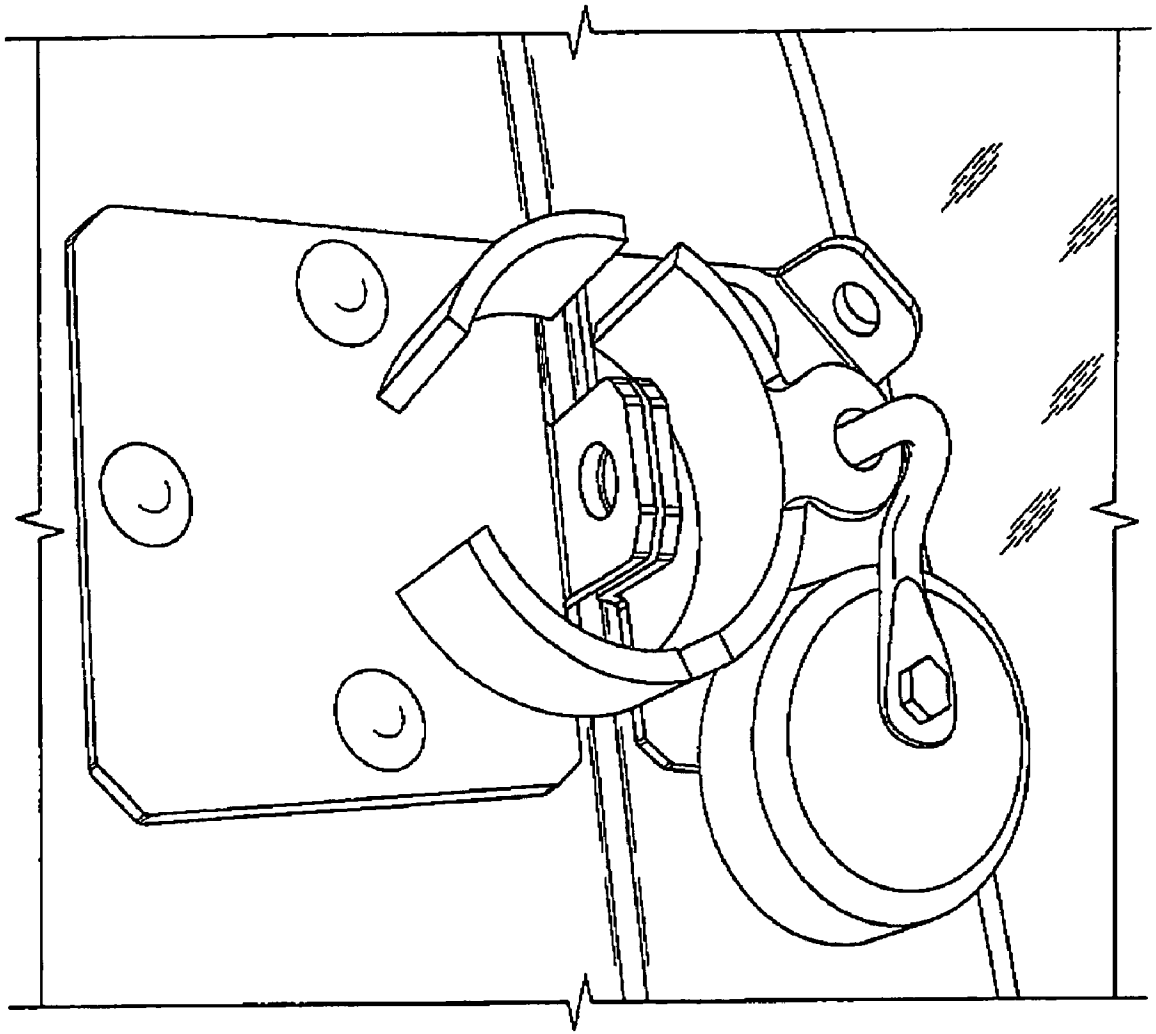

In a further embodiment of the present invention, where the lock 20 is to be used to secure a truck with a rolling rear gate or e.g., a storefront or garage with a rolling gate, the guard (12) is one complete piece, as shown in FIGS. 3 and 5, as opposed to axially split into two pieces like the embodiments described with reference to FIGS. 1, 2, 7, 8, 9. Also, in this embodiment, the hasp plate (32), as shown in FIGS. 3 and 4, is one complete piece. Guard 12 has an opening to allow for key access to the lock 20. Hasp plate 32 has flange 80 with a hole at its center mounted perpendicular to the hasp plate 32. Hasp plate 32 has an opening 81 to receive a cylindrical pole 91 of a planar metal plate 90. Guard 12 has a planar metal plate 90 mounted to the bottom rear of the guard 12, such that the bottom of the guard 12 rests flush against the planar metal plate 90. Plate 90 has an opening 92 to accommodate flange 80. When the lock is assembled, extending from the rear of plate 90, adjacent and underneath flange 80 is a cylindrical pole 91. Pole 91 fits into opening 81, when the guard/plate combination (12, 90) is joined with hasp plate 32. Flange 80 fits in the channel of the lock 20 and, when the bolt is extended across the channel of lock 20, the bolt will slide through the center hole of flange 80, so as to engage the lock 20.

Guard 12 has an outer flange 33 with a hole at the center, mounted perpendicular to the hasp plate 32. Lock 20 has a lock securing member 60 with one end 61 attached to the outer face 22 of lock 20 and a second hook end 62 that extends past the edge of lock 20. Lock securing member 60 and flange 33 are considered independent elements of the invention. In an alternate exemplary embodiment, hook end 62 can be implemented without stopper 64, allowing the user to slide the hook end 62 out through outer flange 34 and reinsert its end portion 63 first into the hole of the outer flange 33 to secure the hook/lock combination when it is not in use. Flange 33 is also of the same size and shape as the channel of the lock 20, so that the perpendicularly oriented flange 33 fits inside the channel of the lock 20, thereby holding lock 20 in place when it is not in use. Hasp plate 32 is mounted to the outside frame of the rolling gate, such that when the guard/plate combination (12, 90) is joined with hasp plate 32 and lock 20 is engaged, pole 91 extends inward through the outside frame and blocks the wheels of the rolling gate, thereby preventing the gate from being opened.

In another embodiment of the present invention, as shown in FIGS. 3 and 4, hasp plate 32 has an outer flange 34 with a hole at the center, mounted parallel to hasp plate 32. Lock 20 has a lock securing member 60 with one end 61 attached to the outer face 22 of lock 20 and a second hook end 62 that extends past the edge of the lock 20. Lock securing member 60 and flange 34 are considered independent elements of the invention. Hook end 62 is approximately the width of the guard (12) such that the hook end 62 begins at the hasp plate (30, 31) and extends orthogonally from the hasp plate (30, 31) approximately the length the guard 12 orthogonally extends from the hasp plate (30,31). End portion 63 of the hook end 62 has a metal stopper 64 mounted to it. Stopper 64 has a diameter greater than the center hole of flange 34, such that the hook/lock combination can be lifted out of the guard 12 (clearing the top portion of the guard 12) and rotate to the side, when the lock is not engaged. Stopper 64 prevents the hook end 62 from being removed from flange 34.

In another embodiment of the present invention, lock securing member 60 is separate from lock 20 and can be attached to any pre-existing cylindrical lock. Flange 50 is separate from guard 10, and can be attached to any pre-existing guard. Flange 70 is separate from hasp plate 31 and can be attached to any pre-existing hasp plate.

An additional embodiment of the present invention comprises a lock securing member/flange combination. In this embodiment, end portion 63 of hook end 62 of lock securing member 60 has a metal stopper 64 mounted to it. Stopper 64 has a diameter greater than the center hole of flange 50, such that stopper 64 prevents hook end 62 from being removed from flange 50. Said lock securing member/flange combination can be mounted or attached to any pre-existing cylindrical lock and guard for said lock.

A further embodiment of the present invention comprises hasp plate 31, guard 10, lock securing member 60, flange 50 and/or flange 70. Said embodiment can be used to replace a pre-existing hasp plate/guard combination that does not include means to store a lock when not in use.

A further embodiment of the present invention comprises a kit used to retrofit a pre-existing lock. The kit comprises lock securing member 60, and flanges 50 and/or 70 which can be attached to a pre-existing hasp plate. Said kit can also include a hasp plate/guard combination with flanges 50 and/or 70 pre-attached.

The foregoing embodiments are illustrative of the invention and are not meant to limit the scope thereof. Other embodiments falling within the scope of the invention will be readily apparent to those of skill in the art.

I claim:

1. A locking system comprising a cylindrical padlock, a lock securing member attached to said cylindrical padlock comprising a first end for attachment to an outer face of said cylindrical padlock and a second hook end having a stopper, wherein said second hook end is rigidly disposed substantially orthogonally to said first end, a padlock guard, a hasp plate, and at least one of the following: an outer flange on said padlock guard mounted parallel to said hasp plate or an outer flange on said hasp plate mounted perpendicular to said hasp plate.

2. The locking system of claim 1, wherein said padlock guard and said hasp plate are axially split in two pieces.

3. The locking system of claim 1, wherein said lock securing member has said first end attached to an outer face of said cylindrical padlock and said second hook end that extends past an edge of said cylindrical padlock.

4. The locking system of claim 3, wherein said second hook end is approximately the width of said padlock guard.

5. The locking system of claim 1, wherein said padlock guard has an opening to allow for key access to said cylindrical padlock.

6. The locking system of claim 1, wherein (a) said hasp plate has an additional flange mounted perpendicular to said hasp plate and an opening directly underneath said additional flange, (b) said padlock guard has a planar metal plate mounted to a bottom surface of said padlock guard, wherein said planar metal plate has an opening to accommodate said additional flange and said planar metal plate has a cylindrical pole extending from a rear of said planar metal plate such that said cylindrical pole fits into said opening of said hasp plate when said guard is joined to said planar metal plate and thereafter together joined with said hasp plate.

7. The locking system of claim 6, wherein said lock securing member has said first end attached to an outer face of said cylindrical padlock and said second hook end that has a length greater than the width of said cylindrical padlock.

8. The locking system of claim. 7, wherein said second hook end is approximately the width of said padlock guard and further comprises a stopper.

9. A lock securing member comprising a first end for attachment to an outer face of a cylindrical padlock and a second hook end having a stopper for attachment to a hasp plate, wherein said second hook end is rigidly disposed substantially orthogonally to said first end and wherein said second hook end has a length greater than the width of said cylindrical padlock to allow movement of the cylindrical padlock and second hook end away from the hasp plate.

10. A kit for retrofitting a pre-existing cylindrical lock comprising a lock securing member comprising a first end for attachment to an outer face of a cylindrical padlock and a second hook end having a stopper, wherein said second hook end is rigidly disposed substantially orthogonally to said first end and at least one of the following: a flange for attachment to a pre-existing hasp plate or a hasp plate/guard combination with at least one pre-attached flange.

* * * * *